US006668416B1

(12) United States Patent
Georgi et al.

(10) Patent No.: US 6,668,416 B1
(45) Date of Patent: Dec. 30, 2003

(54) TOOTHBRUSH

(75) Inventors: Matthias Georgi, Buehl (DE); Hans Krämer, Buehl (DE)

(73) Assignee: GlaxoSmithKline Consumer Healthcare GmbH & Co. KG, Buehl (DE)

( * ) Notice: Subject to any disclaimer, the term of this patent is extended or adjusted under 35 U.S.C. 154(b) by 0 days.

(21) Appl. No.: 09/979,260

(22) PCT Filed: May 18, 2000

(86) PCT No.: PCT/EP00/04619

§ 371 (c)(1),
(2), (4) Date: Feb. 27, 2002

(87) PCT Pub. No.: WO00/70997

PCT Pub. Date: Nov. 30, 2000

(30) Foreign Application Priority Data

May 24, 1999 (GB) ..... 9912044
May 24, 1999 (GB) ..... 9912050

(51) Int. Cl.[7] ..... A46B 9/04
(52) U.S. Cl. ..... 15/167.1; 15/172

(58) Field of Search ..... 15/167.1, 172

(56) References Cited

U.S. PATENT DOCUMENTS

| | | | | |
|---|---|---|---|---|
| 5,630,244 | A | | 5/1997 | Chang |
| 5,765,254 | A | * | 6/1998 | O'Halloran |
| 5,903,949 | A | * | 5/1999 | Halm |

FOREIGN PATENT DOCUMENTS

| | | | |
|---|---|---|---|
| DE | 8814824 | U | 8/1989 |
| DE | 4222931 | C1 | 12/1993 |
| WO | WO 9315627 | A | 8/1993 |
| WO | WO 9628993 | A | 9/1996 |

* cited by examiner

*Primary Examiner*—Randall E. Chin
(74) *Attorney, Agent, or Firm*—Nora Stein-Fernandez; Theodore R. Furman

(57) ABSTRACT

A toothbrush having a resiliently flexible composite region between its head and handle which comprises one or members of generally triangular shape in section either made of a resilient elastomeric material different to the hard plastic material of the toothbrush head and handle, or made of a hard plastic material.

31 Claims, 5 Drawing Sheets

TOOTHBRUSH

FIELD OF THE INVENTION

This invention relates to toothbrushes, in particular to toothbrushes having a feature in their structure to modify flexibility.

BACKGROUND OF THE INVENTION

Toothbrushes are known which have a feature in their structure to modify their flexibility during use. For example EP 0 033 641A discloses a toothbrush having a series of 'S' bends in its handle, and DE 39 234 95A discloses a toothbrush having cut-outs in its handle which contain a flexible elastomer. Such features are included in a toothbrush to absorb excessive brushing forces.

It is an object of this invention to provide an alternative structure of toothbrush having a flexibility-modifying feature in its structure.

SUMMARY OF THE INVENTION

According to this invention a toothbrush is provided having a head and a handle being made of a hard plastic material and being disposed along a longitudinal axis, the head having bristles extending therefrom in a bristle direction which is generally perpendicular to the longitudinal direction, the toothbrush having a width direction generally perpendicular to both the longitudinal axis direction and the bristle direction, the toothbrush having a resiliently flexible composite region between its head and handle characterised in that the composite region comprises one or more members which are generally triangular shape in section when cut in a plane parallel to the longitudinal direction and perpendicular to the width direction, each of the triangular shapes having an apex which points in a direction either generally in the bristle direction or generally at a direction 180° to the bristle direction, the at least one triangular sectioned member comprising either at least one triangular sectioned member made of a resilient elastomeric material different to the hard plastic material of the toothbrush head and handle situated longitudinally between two adjacent regions of a hard plastic material, or at least one triangular sectioned member made of a hard plastic material situated longitudinally between two adjacent regions of elastomeric material different to the hard plastic material of the toothbrush head and handle.

DETAILED DESCRIPTION, OF THE INVENTION

BRIEF DESCRIPTION OF THE DRAWINGS

FIG. 1 shows a toothbrush of the first embodiment of this invention

FIG. 2 shows the "skeleton" of a toothbrush of FIG. 1

FIG. 3 shows an alternative construction of the toothbrush of the first embodiment of this invention.

FIG. 4 shows a toothbrush of the second embodiment of this invention.

FIG. 5 shows the skeleton of the toothbrush of FIG. 4.

Figure 1A:
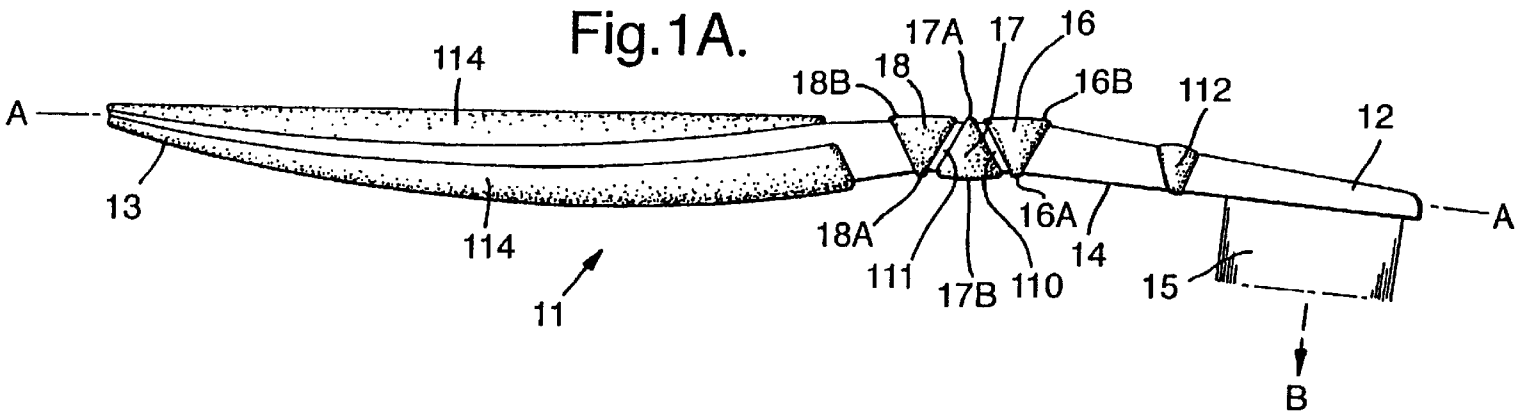
FIG. 1A shows a side view of a first embodiment of a toothbrush of this invention.

In a first embodiment the one or more member is/are made of elastomeric material and is constructed such that as a bending force is applied to the toothbrush head the adjacent hard plastic material bears upon an elastomeric member to apply compressive pressure to the member.

In a second embodiment the one or more member is/are made of hard plastic material and is constructed such that as a bending force is applied to the toothbrush head the hard plastic material bears upon an adjacent region of elastomeric material to apply compressive pressure to the region of elastomeric material.

Preferably there is more than one triangular sectioned member, for example two or three such triangular sectioned members, being sequentially longitudinally disposed in the toothbrush, and the respective directions in which the apexes of longitudinally adjacent members point are 180° apart, i.e. so that with any two longitudinally adjacent members the apex of one will point generally in the bristle direction and the apex of the adjacent neighbouring member will point generally in the opposite direction.

For example if there are three such longitudinally adjacent members the apex of two of the members may point in the bristle direction and the apex of the member in between the two may point in the 180° opposite direction, or the apex of the central member may point in the bristle direction and the apex of the members on longitudinally either side may point in the 180° opposite direction.

The term "generally triangular" includes triangles of all types, e.g. isosceles triangles, equilateral triangles. The term also includes triangles with one or more rounded apexes or curved sides. The term also includes three-sided shapes with concave or convex curved sides, ogival shapes or pointed arch shapes. The term also includes semi-circular or semi-elliptical shapes. The term also includes polygonal shapes with more than three sides but which are generally triangular, for example hexagons having alternating relatively long and relatively short sides, and quadrilaterals having a relatively long base and a relatively short side opposite the base, with the other two sides tapering toward the short side to thereby define an apex angle, e.g. an acute apex angle between them.

Preferably the generally triangular sectioned member(s) is/are generally prismatic in shape, having generally parallel edges which extend generally in the width direction of the toothbrush.

Preferably the generally triangular sectioned member(s) extend(s) substantially or entirely through the entire thickness dimension of the toothbrush, i.e. the dimension through the toothbrush which is generally perpendicular to both the longitudinal axis and the width direction, so that the apex of the triangular shape is exposed on a first surface of the toothbrush and/or the opposite base of the triangular shape is exposed on the opposite surface of the toothbrush distanced from the first surface by the thickness dimension.

Preferably at least one generally triangular sectioned member extends across the whole width of the toothbrush, so that for example a generally triangular shaped end surface of a prismatic member is exposed on each widthways separated side of the toothbrush.

Preferably in the first embodiment (i.e. with one or more elastomeric triangular sectioned member) there are at least two, particularly three, of the elastomeric members with a region of the hard plastic material longitudinally between each pair of them.

In the first embodiment preferably at least one, preferably both of the adjacent regions of a hard plastic material have a surface which is inclined at a non-perpendicular angle to the longitudinal direction, so that the surfaces of the adjacent regions of plastic material define an acute angle between them, being the apex angle of the triangular sectioned member. In such a construction as a bending force is applied to the toothbrush head the plastic material of the inclined surfaces bears upon an elastomeric member to apply compressive pressure to the member. Preferably there is such a surface at each longitudinal end of the composite region. If there are two or more triangular sectioned members then between longitudinally adjacent pairs of the members such plastic parts are preferably substantially planar, each longitudinally opposed surface of such a planar part comprising such an inclined surface. Longitudinally adjacent pairs of the hard plastic material parts may be integrally linked by one or more thin integral bridge of the plastic material, being thin enough to be flexible. For example the plastic parts may comprise two or more such planar parts inclined toward each other to define an apex angle, e.g. an acute angle between them, and linked together adjacent to an apex of the triangular member to form a "V" shaped fold with the fold axis aligned transverse to the longitudinal direction. A plurality of such parts may be integrally formed linked together to form a zig-zag, or "Z", folded region.

Preferably in the second embodiment (i.e. with one or more hard plastic triangular sectioned member) there are at least two, particularly three, of the hard plastic material members with a region of the elastomeric material longitudinally between each pair of them.

In the second embodiment preferably at least one, preferably both of the adjacent regions of elastomeric material have a surface which is inclined at a non-perpendicular angle to the longitudinal direction, so that the surfaces of the adjacent regions of elastomeric material define an acute angle between them, being the apex angle of the triangular sectioned member. In such a construction as a bending force is applied to the toothbrush head the plastic material of the triangular sectioned hard plastic members bears upon an elastomeric member between them to apply compressive pressure to the member. Preferably there is such a surface at each longitudinal end of the composite region. If there are two or more triangular sectioned members then between longitudinally adjacent pairs of the members such elastomeric parts are preferably substantially planar, each longitudinally opposed surface of such a planar part comprising such an inclined surface.

Longitudinally adjacent pairs of the hard plastic triangular sectioned members of this second embodiment, and adjacent hard plastic material parts of the toothbrush, may also be linked by one or more thin flexible structure of the hard plastic material, for example one or more of said structure(s) being in the form of a thin integrally moulded bridge bridging longitudinally adjacent pairs of the members.

One or more of the hard plastic triangular sectioned members of this second embodiment members may also be longitudinally penetrated by a longitudinally extending "core" of an elastomeric material which may itself integrally link the elastomeric pads. The parts of the core between the members and/or between the member(s) and a longitudinally adjacent part of the toothbrush structure may comprise the pads.

Preferably the toothbrush of the invention comprises a hard plastic "skeleton" having one or more cavity in its structure which correspond to the position of the elastomer parts of the toothbrush, and the elastomer part(s) occupies the one or more cavity. Such a "skeleton" may be integrally made of the hard plastic material, in which the one or more cavity is/are integrally bridged by one or more thin flexible structure(s) of the hard plastic material to which the elastomer material is moulded. The general idea of making two component toothbrushes using a first component hard plastic skeleton having one or more cavity therein about which are subsequently moulded one or more second component elastomer parts is well known in the art, for example from WO 94/05183 and others.

The hard plastic parts of the toothbrush may be made of any hard plastic material as is presently used in the manufacture of toothbrushes, e.g. as disclosed in EP 0 033 641A or WO 99/17915. Polypropylene materials are often used. The elastomer material may be any elastomer material or any elastomer material which is presently used in the manufacture of toothbrushes e.g. as disclosed in WO 99/17915, WO 92/17092 or WO 92/17093. Many such two component toothbrushes are known and there is a prolific choice of suitable hard plastics and elastomeric materials.

The composite region may be located in any desired location in the toothbrush. For example the member(s) may be located in the grip handle part of the toothbrush; and/or between the grip handle part and the head of the toothbrush for example between the grip handle and the thinner "neck"

that usually lies between the handle and the head of a toothbrush, or in such a neck, and/or between the part of the head immediately adjacent to such a neck and the neck itself. When located between the part of the head immediately adjacent to the neck and the neck itself the apex of the triangular shape may point in the bristle direction or in the opposite direction.

When there is more than one triangular sectioned member each may have the same or different dimensions or be made of the same or a different material, particularly in the first embodiment, with elastomeric members so that each member may have the same or different flexibility e.g. compressibility or stretchability, characteristics.

The toothbrush of the invention may also include other known features of toothbrushes, for example the elastomer grip pads disclosed in EP 0 033 641A or the flexible head construction disclosed in WO 97/07707, WO 98/37788 or WO 92/17093, or the flexible link between the head and handle disclosed in WO 92/17092 or WO 97/24949 or EP 0 613 636A. The contents of these disclosures are included herein in their entirety by way of reference.

The bristles of the toothbrush of this invention may be entirely conventional, for example made of known materials and may be fixed into the head by known techniques such as the widely used small metal "anchors", or fused and welded into the plastic material of the head via known "anchorless" bristling processes.

The toothbrush of the invention is preferably made using an injection moulding process in which a hard plastic "skeleton" having one or more cavity corresponding to the position of the elastomer part(s) of the toothbrush, is first made in a first moulding operation using a first mould cavity, and the elastomeric part(s) is/are then made in this second moulding operation by positioning the skeleton in a second mould having one or more cavities corresponding to the elastomer member(s) and a fluid elastomer is then injected into the aperture(s) in the skeleton to thereby form the elastomeric part(s) of the toothbrush.

Such a process comprises a further aspect of this invention.

The invention also provides injection moulds suitable for use in the above-described process having a first cavity in which the hard plastic parts of the toothbrush are made and/or a second cavity in which the elastomer part(s) of the toothbrush are made.

The invention will now be described, by way of example only, with reference to the accompanying drawings.

Figure 1B:
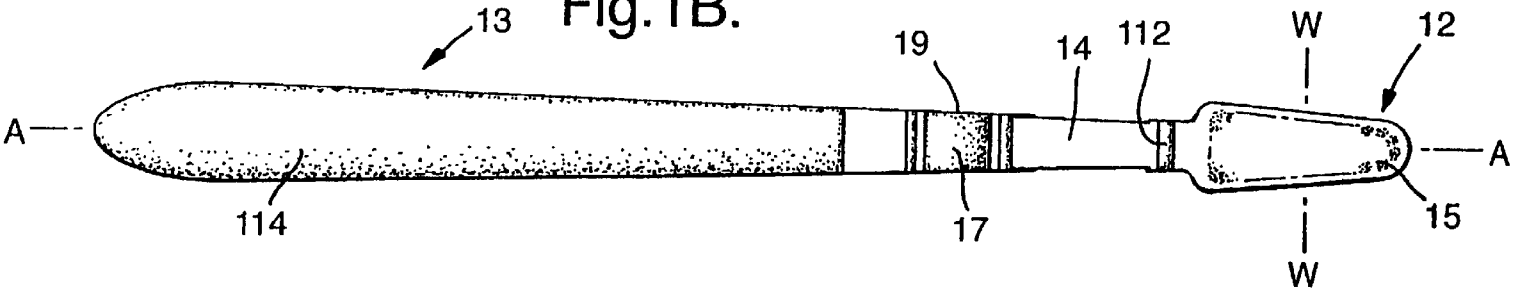
FIG. 1B shows a plan view of the toothbrush of FIG. 1A looking down onto the face of the head from which the bristles extend.
Figure 1C:
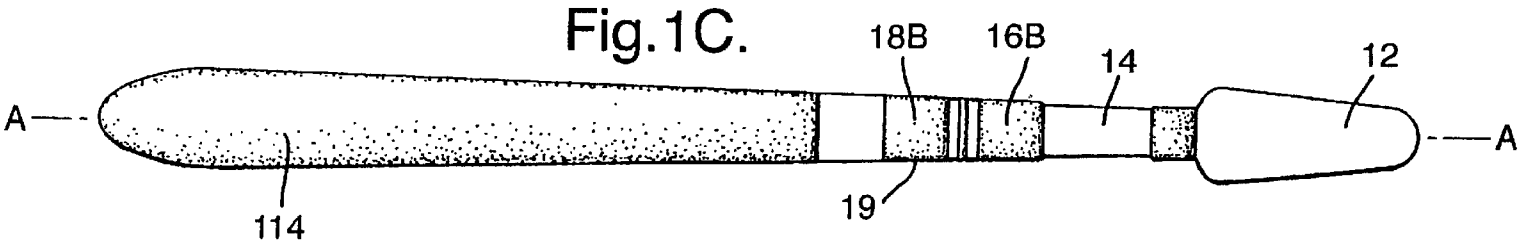
FIG. 1C shows a plan view of the toothbrush of FIG. 1A looking down onto the opposite face of the head to that from which the bristles extend.

Referring to FIG. 1, a toothbrush (overall 11) is shown in a side view in FIG. 1A, in plan view in FIG. 1B, and in underside view in Fig. 1C.

The toothbrush 11 comprises a head 12, and a handle 13 disposed along the longitudinal axis A—A, with a neck region 14 between the head 12 and handle 13, and being integrally made of hard plastic material. Bristles 15 (shown schematically) extend from the head 12 in a general bristle direction B—B. The toothbrush 11 has a width direction W—W generally perpendicular to both A—A and B—B.

The toothbrush 11 includes three members 16, 17, 18 made of an elastomer material, being sequentially longitudinally disposed along the toothbrush 11, and located between the handle 13 and neck 14.

Each of the members 16, 17, 18 is of a generally triangular prism shape, with generally triangular shape ends 19, exposed on opposite widthways separated sides of the toothbrush 11. The triangular shape of the sections of the members 16, 17, 18 have slightly curved sides and rounded apexes. Each of the members 16, 17, 18 extends entirely across the width of toothbrush 11, and entirely through the thickness of toothbrush 11, so that in each member 16, 17, 18 an apex e.g. 16A is exposed on one surface of the toothbrush 11 and an opposite base e.g. 16B is exposed on the opposite surface of the toothbrush 11 separated by the thickness dimension i.e. in the direction B—B.

It is seen that with each of the members 16, 17, 18 an apex 16A, 17A, 18A points either in the bristle direction B—B or in the 180° opposite direction relative to the bristle direction B—B.

It is also seen that longitudinally between each pair of the longitudinally adjacent members 16, 17, 18 is a thin, substantially planar, region 110, 111 of the hard plastic material of the head 12 and handle 13 inclined at a non-perpendicular angle to the longitudinal direction, so that the surfaces of the adjacent regions of plastic material 110, 111 define an acute angle between them.

The section of each of the members 16, 17, 18 is substantially an equilateral triangle, but the exposed base 16B, 17B, 18B is slightly convex curved. Longitudinally adjacent sides of the triangles 16, 17, 18 are substantially parallel with the hard plastic region 110, 111 between.

Located between the base of the head 12, i.e. the part of the head 12 immediately adjacent to neck 14 is another elastomer member 112, again in the form of a generally triangular sectioned prism, this time being an isosceles triangle with its apex 112A facing in the bristle direction B—B and its short, slightly curved base 112B facing in the 180° direction, and its triangular ends 113 exposed on either side of the toothbrush 11.

The handle 13 of the toothbrush. 11 is also provided with elastomer grip pads 114.

Figure 2A:
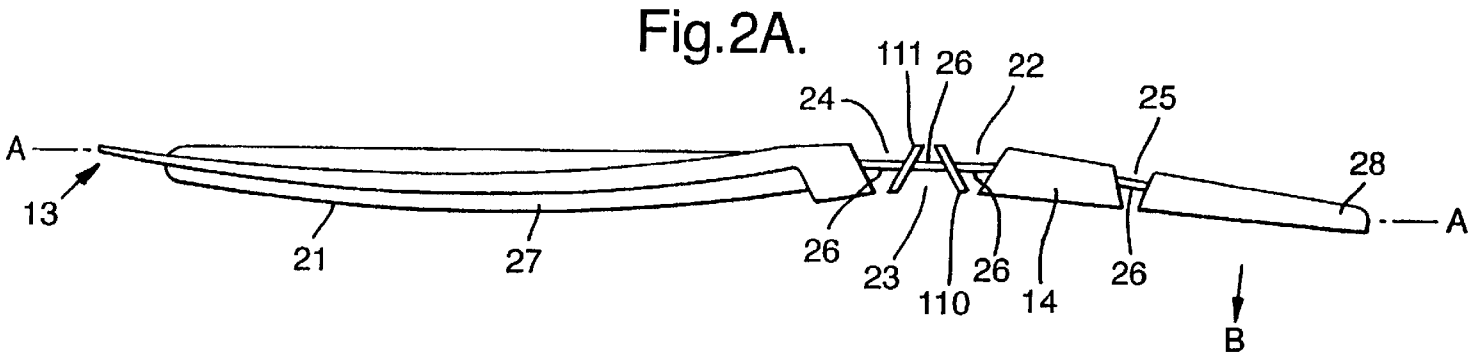
FIG. 2A shows a side view of the plastic material skeleton of the toothbrush of FIGS. 1A–1C.
Figure 2B:
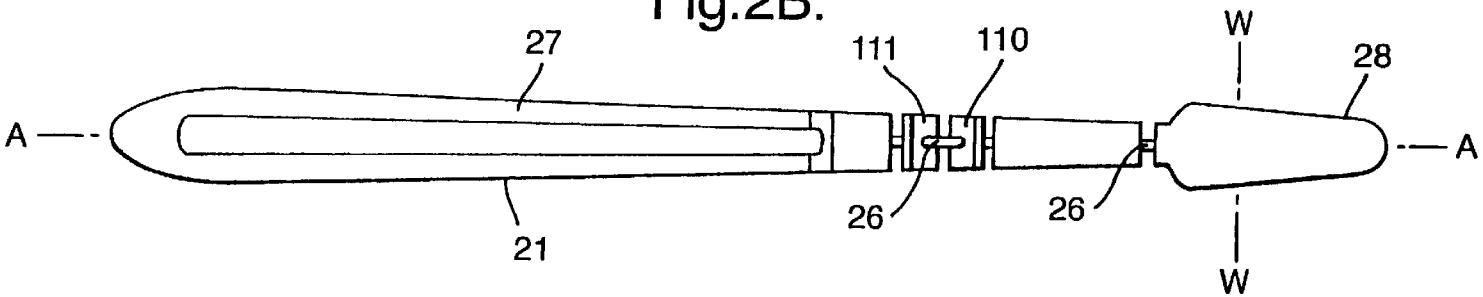
FIG. 2B shows a plan view of the plastic material skeleton of the toothbrush of FIGS. 1A–1C looking down onto the face of the head from which the bristles extend.
Figure 2C:
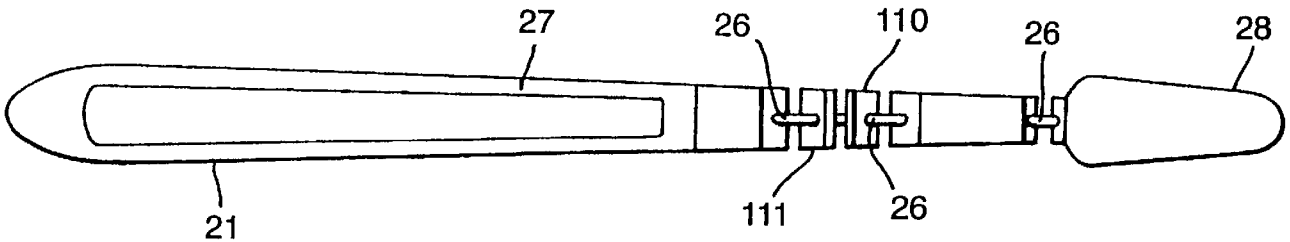
FIG. 2C shows a plan view of the plastic material skeleton of the toothbrush of FIGS. 1A–1C looking down onto the opposite face of the head to that from which the bristles extend.

Referring to FIG. 2, features corresponding to those of the toothbrush of FIG. 1 are numbered to correspond. FIG. 2 shows a toothbrush "skeleton" 21 overall being only the hard plastic parts of the toothbrush of FIG. 1.

In the skeleton 21, the places to be occupied by the elastomer members 16, 17, 18 and 112 are represented by cavities 22, 23, 24, 25 into which a fluid elastomeric material (not shown) can be injected. The cavities 22, 23, 24, 25 are longitudinally bounded by adjacent regions of a hard plastic material which have a surface which is inclined at a non-perpendicular angle to the longitudinal direction, so that the surfaces of the adjacent regions of plastic material define an acute angle between them, being the apex angle of the triangular sectioned member 16, 17, 18, 112 located between pairs of such surfaces. The cavities 22, 23, 24, 25 are bridged by thin plastic bridge structures 26 integrally of the hard plastic material, around which the elastomeric material 16, 17, 18 and 112 is moulded and bonds under the conditions of the injection moulding of the elastomer (suitable moulding conditions to achieve such a bond are known in the art). The structures 26 therefore penetrate longitudinally right through the members 16, 17, 18. The structures 26 may or may not contribute resilience or stiffness to the composite of elastomer and hard plastic so formed. The skeleton also has cavities 27 corresponding to the position of the grip pads 114. Although shown as small cylindrical rods the structures 26 may have any desired cross section e.g. being elongate in a particular direction so as to modify the flexibility about a particular bend axis.

The head part 28 of the skeleton 21 also includes holes (not shown) for the subsequent insertion of bristles 15.

Typically the skeleton 21 is made integrally by providing a cavity of a corresponding shape in a steel mould (not shown) and injecting fluid plastic material into the cavity. The skeleton 21 is then removed from the dis-assembled mould and inserted into a second mould (not shown) which has cavities corresponding to the shape and position of the members 16, 17, 18, 112 and the pads 114. Fluid elastomer material is then injected into the cavities of the second mould so as to form the elastomer parts 16, 17, 18, 112 and 114. Such a process is known in the art, e.g. in WO 94/05183.

Referring to FIG. 3, features corresponding to those of FIGS. 1 and 2 are numbered correspondingly. FIG. 3 shows a toothbrush 31 similar in concept to that of FIG. 1, having three elastomer members 32, 33, 34 with their apexes 32A, 33A and 34A pointing in a corresponding direction to those of members 16, 17, 18 of FIG. 1.

Figure 3A:
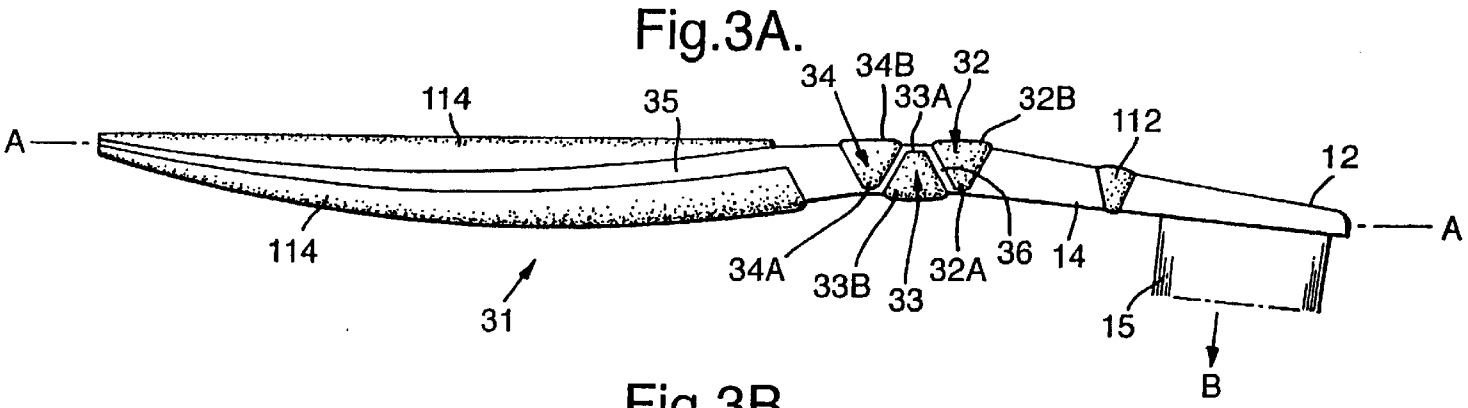
FIG. 3A shows a side view of an alternative construction of a toothbrush of the first embodiment of this invention.
Figure 3B:
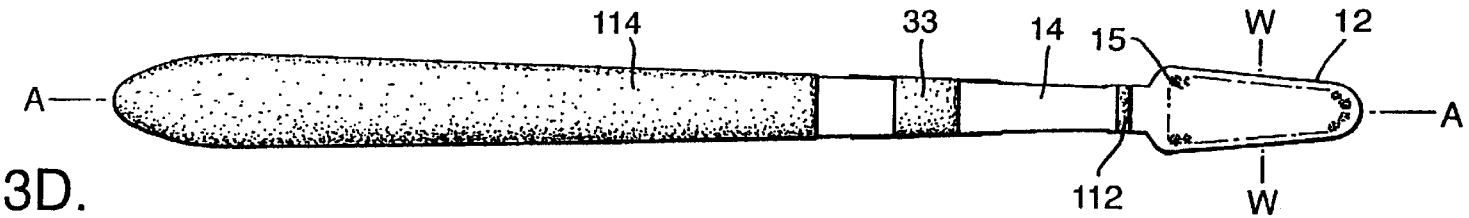
FIG. 3B shows a plan view of the toothbrush of FIG. 3A looking down onto the face of the head from which the bristles extend.
Figure 3D:
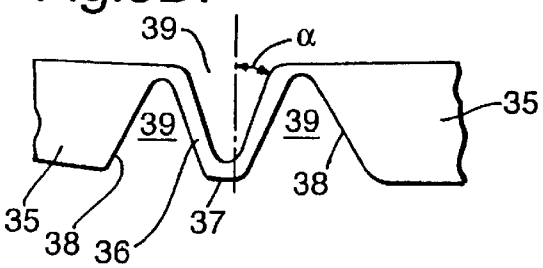
FIG. 3D shows a side view of the folded region of the hard plastic skeleton without the elastomer material in place.
Figure 3C:
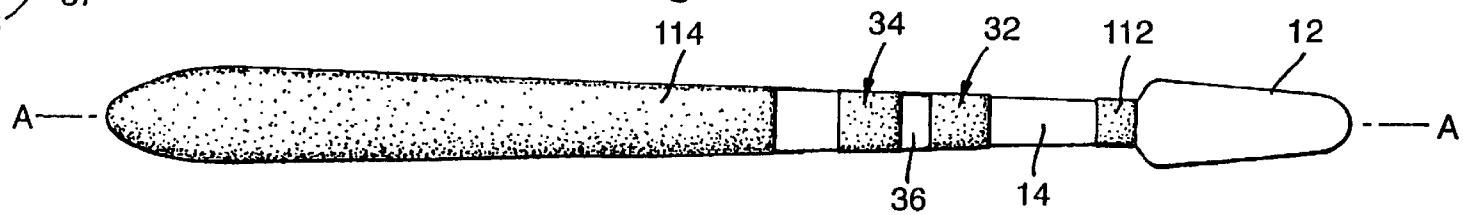
FIG. 3C shows a plan view of the toothbrush of FIG. 3A looking down onto the opposite face of the head to that from which the bristles extend.

However in the toothbrush 31 of FIG. 3 the skeleton 35 of the toothbrush includes an integral region of zigzag folded thin leaves 36 shown in more detail in FIG. 3D. Each of the leaves 36 is substantially planar with its plane at an angle ax less than 90° to the longitudinal axis, so as to form an acute angle between longitudinally adjacent leaves 36. The leaves 36 are sufficiently thin that they are resiliently flexible. This construction is shown more clearly in FIG. 3D, where the folded region of the hard plastic skeleton is shown without the elastomer material in place. A "V" shaped fold is shown, with its fold axis aligned parallel to the width direction W—W, i.e. perpendicular to the plane of the paper of FIG. 3D, and its apex 37 adjacent to and defining an apex of a triangular sectioned member (33 not shown in FIG. 3D). In the construction shown in FIGS. 1 to 3 each elastomeric member 32, 33, 34 is located between longitudinally adjacent regions of hard plastic material having a surface which is inclined at a non-perpendicular angle to the longitudinal direction, so that the surfaces of the adjacent regions of plastic material define an acute angle between them, being the apex angle of the triangular sectioned member. The surfaces 38 of the skeleton 35 are at the longitudinal ends of the composite region are also inclined at a non-perpendicular angle to the longitudinal direction. Spaces 39 are thereby defined for the subsequent formation therein of the elastomeric members 32, 33, 34 in an injection moulding stage.

Elastomeric members 32, 33, 34 are formed in the angles between adjacent leaves 36, being consequently substantially triangular in section when cut by the plane parallel to the longitudinal axis A—A and the bristle direction B—B. The shapes of the sections of the members 32, 33, 34 are quadrilaterals, having opposite facing substantially parallel relatively short and relatively long sides comprising the apex 32A, 33A, 34A and the base 32B, 33B, 34B respectively of a generally triangular shape, and sloping sides which converge from the base toward the apex. Apexes 32A, 33A, 34A is defined by the junction between adjacent leaves 36, and an opposite base 32B, 33B, 34B is exposed at the surface of the toothbrush 31.

The toothbrush 31 is made by a process similar to that of toothbrush 11 above, i.e. a "skeleton" 35 made of the hard plastic material of the head 12 and handle 13 is made by injection moulding, and including integrally the region of leaves 36. The skeleton 35 is then placed in a second injection mould having cavities corresponding to the position and dimensions of the members 32, 33, 34 to be formed. These members 32, 33, 34 are then made by injecting fluid elastomer material into these cavities of the mould.

In use each of the toothbrushes 11, 31 works in the same way. Pressure applied to the head 12 by using it to brush the teeth transmits a bending force to the region of the toothbrush 11, 31 where the members 16, 17, 18, 32, 33, 34 are. The thin leaves 26, 36 easily bend, causing compressive force to be applied to the members 16, 17, 18, 32, 33, 34. These elastomeric members 16, 17, 18, 32, 33, 34 consequently absorb excessive brushing pressure.

Figures 4A, 4B, 4C, 4D:
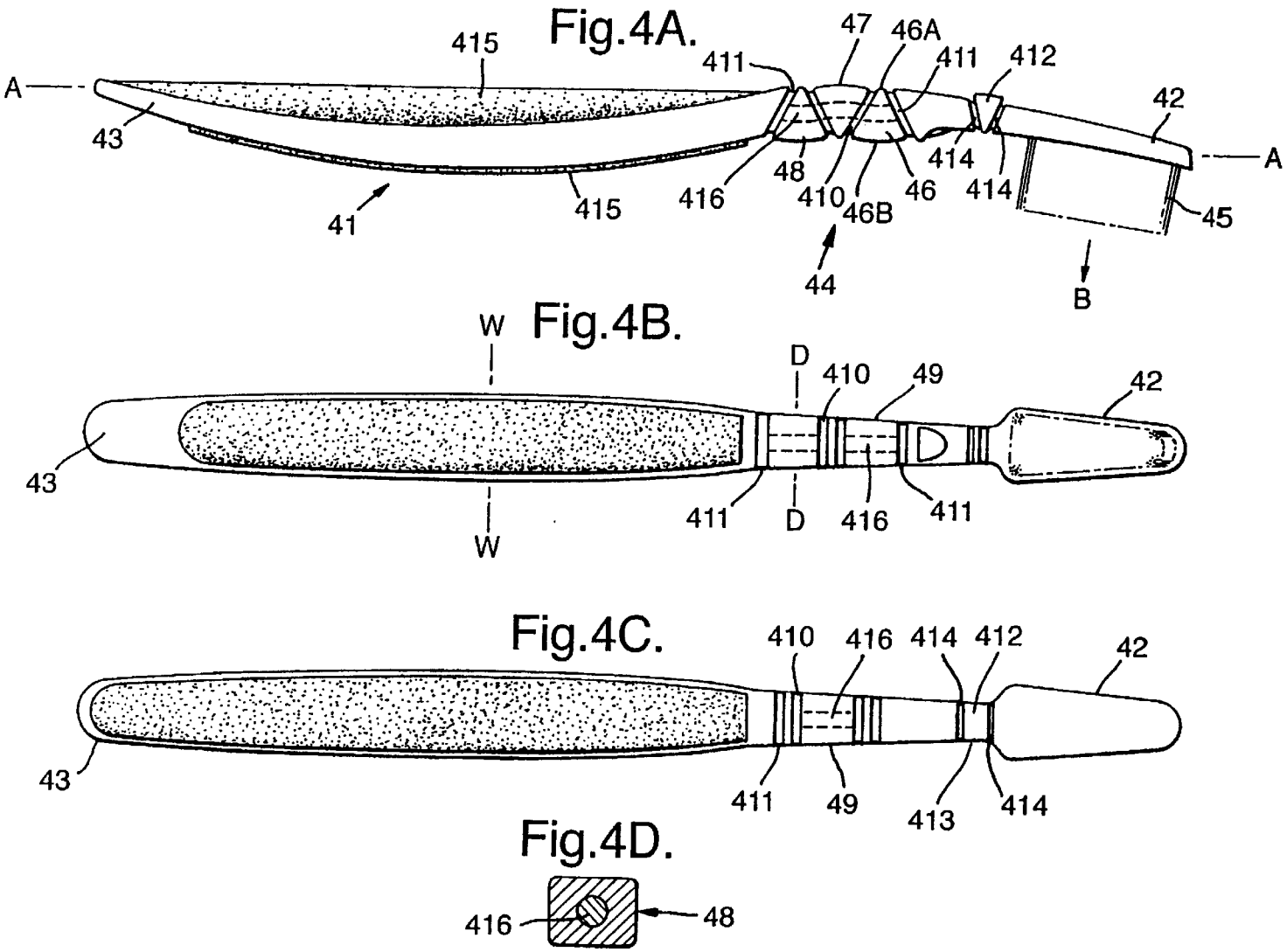
FIG. 4A shows a side view of a toothbrush of the second embodiment of this invention.
FIG. 4B shows a plan view of the toothbrush of FIG. 4A looking down onto the face of the head from which the bristles extend.
FIG. 4C shows a plan view of the toothbrush of FIG. 4A looking down onto the opposite face of the head to that from which the bristles extend.
FIG. 4D shows an enlarged cross section about line D—D of FIG. 4B.

Referring to FIG. 4, a toothbrush (overall 41) is shown in a side view in FIG. 4A, in plan view in FIG. 4B, in underside view in FIG. 4C, and inna cross section at D—D in FIG. 4D.

The toothbrush 41 comprises a head 42, and a handle 43 disposed along the longitudinal axis A—A, with a neck region 44 between the head 42 and handle 43, and being integrally made of hard plastic material. Bristles 45 (shown schematically) extend from the head 42 in a general bristle direction B—B. The toothbrush 41 has a width direction W—W generally perpendicular to both A—A and B—B.

The toothbrush 41 includes three members 46, 47, 48 made of the same hard plastic material as the head 42 and handle 43, being sequentially longitudinally disposed along the toothbrush 41, and located between the handle 43 and neck 44.

Each of the members 46, 47, 48 is of a generally triangular prism shape, with generally triangular shape ends 49, exposed on opposite widthways separated sides of the toothbrush 41. The triangular shape of the sections of the members 46, 47, 48 have slightly curved sides and rounded apexes. Each of the members 46, 47, 48 extends entirely across the width of toothbrush 41, and entirely through the thickness of toothbrush 41, so that in each member 46, 47, 48 an apex e.g. 46A is exposed on one surface of the toothbrush 41 and an opposite base e.g. 46B is exposed on the opposite surface of the toothbrush 41 separated by the thickness dimension i.e. in the direction B—B.

It is seen that with each of the members 46, 47, 48 an apex 46A, 47A, 48A points either in the bristle direction B—B or in the 180° opposite direction relative to the bristle direction B—B.

Longitudinally between each pair of the longitudinally adjacent members 46, 47, 48 is a thin pad, e.g. a layer 410 made of an elastomeric material. Longitudinally between each members 46, 48 and the longitudinally adjacent part of the toothbrush handle 43 and neck 44 is also a thin pad, e.g. a layer 411 made of an elastomeric material.

It is also seen that the section of each of the members 46, 47, 48 is substantially an equilateral triangle, but the exposed base 46B, 47B, 48B is slightly convex curved. Longitudinally adjacent sides of the triangles 46, 47, 48 are substantially parallel with the elastomeric pads 410 between.

Located between the base of the head 42, i.e. the part of the head 42 immediately adjacent to neck 44 is another hard plastic member 412, again in the form of a generally triangular sectioned prism, this time being an isosceles triangle with its apex 412A facing in the bristle direction B—B and its short, slightly curved base 412B facing in the 480° direction, and its triangular ends 413 exposed on either side of the toothbrush 41. Longitudinally between the member 412 and the longitudinally adjacent part of the toothbrush handle 43 and neck 44 is also a thin pad, e.g. a layer 414 made of an elastomeric material.

The handle 43 of the toothbrush 41 is also provided with elastomer grip pads 415.

Extending longitudinally through each of the members 46, 47, 48 is a longitudinally extending "core" 416 of an elastomeric material (shown dotted in FIG. 4 because internal and obscured). FIG. 4D shows an enlarged cross section about line D—D of FIG. 4 through exemplary member 48, showing the internal construction with the elastomer core 416. Although shown of circular cross section the core 416 may be of any convenient cross section, e.g. oval, rectangular etc.

Figure 5A:
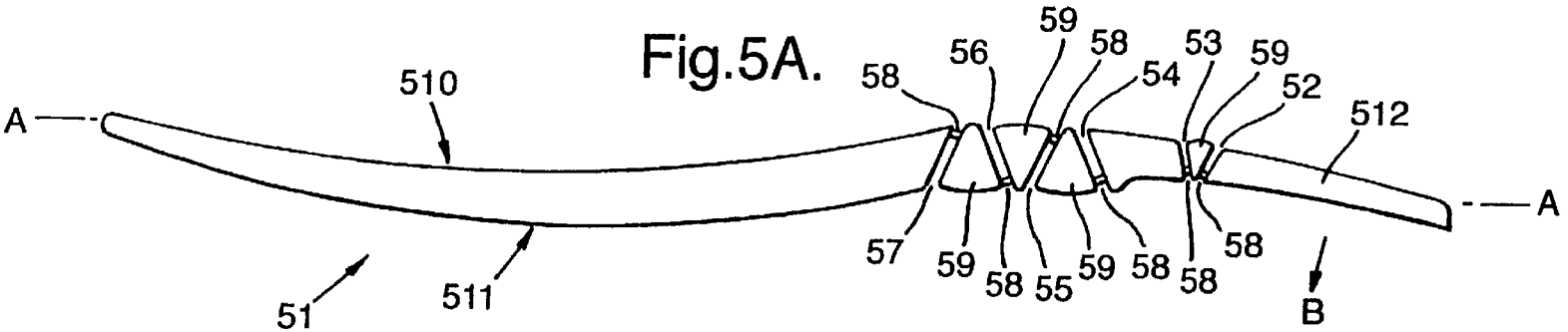
FIG. 5A shows a side view of the plastic material skeleton of the toothbrush of FIGS. 4A–4C.
Figure 5B:
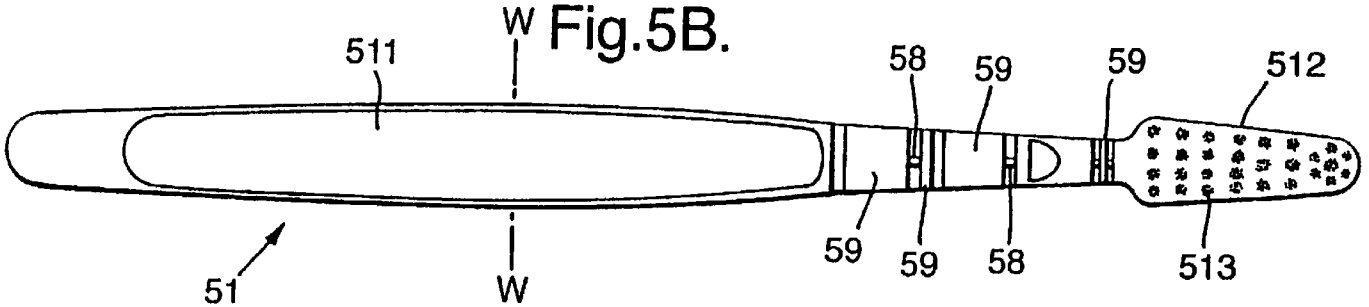
FIG. 5B shows a plan view of the plastic material skeleton of the toothbrush of FIGS. 4A–4C looking down onto the face of the head from which the bristles extend.
Figure 5C:
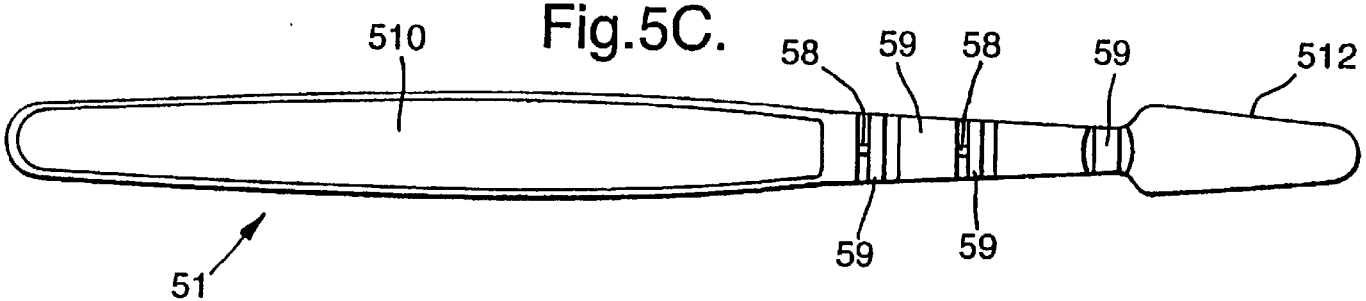
FIG. 5C shows a plan view of the plastic material skeleton of the toothbrush of FIGS. 4A–4C looking down onto the opposite face of the head to that from which the bristles extend.

Referring to FIG. 5, this shows a toothbrush "skeleton" 51 overall being only the hard plastic parts of a toothbrush. This is shown in a side view in FIG. 5A, in plan view in FIG. 5B, and in underside view in FIG. 5C.

In the skeleton 51, the places to be occupied by elastomer pads (not shown) are represented by cavities 52, 53, 54, 55, 56, 57 into which a fluid elastomeric material (not shown) can be injected. The cavities 52, 53, 54, 55, 56, 57 are bridged by thin plastic bridge structures 58 integrally of the hard plastic material, around which elastomeric material of pads to be formed is moulded and bonds under the conditions of the injection moulding of the elastomer (suitable moulding conditions to achieve such a bond are known in the art). The structures 58 are embedded in the elastomeric material during the moulding operation and penetrate longitudinally right through the elastomeric pads (not shown). The structures 58 may or may not contribute resilience or stiffness to the composite of elastomer and hard plastic so formed. Between longitudinally adjacent pairs of the cavities 52, 53, 54, 55, 56, 57 are located triangular sectioned members 59 of hard plastic material. The skeleton 51 also has spaces 510, 511 corresponding to the position of the grip pads (not shown). Although shown as small cylindrical rods the structures 58 may have any desired cross section e.g. being elongate in a particular direction so as to modify the flexibility about a particular bend axis.

The head part 512 of the skeleton 51 also includes holes 513 for the subsequent insertion of bristles (not shown).

Typically the skeleton 51 is made integrally by providing a cavity of a corresponding shape in a steel mould (not shown) and injecting fluid plastic material into the cavity. The skeleton 51 is then removed from the dis-assembled mould and inserted into a second mould (not shown) which has cavities corresponding to the shape and position of the elastomer pads. Fluid elastomer material is then injected into the cavities of the second mould so as to form the elastomer pads in the cavities 52, 53, 54, 55, 56, 57. Such a process is known in the art, e.g. in WO 94/05183.

What is claimed is:

1. A toothbrush having a longitudinal axis, with a head and a handle being made of a hard plastic material and being disposed along said longitudinal axis, the head having bristles extending therefrom in a bristle direction which is generally perpendicular to the longitudinal axis, the toothbrush having a width direction generally perpendicular to both the longitudinal axis and the bristle direction, the toothbrush having a resiliently flexible composite region between its head and handle characterised in that the composite region comprises two longitudinally separated regions of a hard plastic material, and at least one member which is triangular shape in section when cut in a plane parallel to the longitudinal direction and perpendicular to the width direction, the triangular shape having an apex which points in the bristle direction and which is made of a resilient elastomeric material different to the hard plastic material of the toothbrush head and handle which is situated longitudinally between said two adjacent regions of a hard plastic material.

2. A toothbrush according to claim 1 characterised in that the at least one member made of elastomeric material is constructed such that as a bending force is applied to the toothbrush head an adjacent region of hard plastic material bears upon the member to apply compressive pressure to the member.

3. A toothbrush according to claim 2 characterised in that there is more than one said member which is triangular shape in section, being sequentially longitudinally disposed in the toothbrush, and the respective directions in which the apexes of longitudinally adjacent members point are 180° apart.

4. A toothbrush according to claim 2 characterised in that there are at least two members made of an elastomeric material with a region of the hard plastic material longitudinally between the at least two members, each of said members having a surface which is inclined at a non-perpendicular angle to the longitudinal direction, so that the surfaces of the adjacent regions of plastic material define an acute angle between the at least two members, being the apex angle of the triangular sectioned member.

5. A toothbrush according to claim 1 characterised in that there is more than one said member which is triangular shape in section, being sequentially longitudinally disposed in the toothbrush, and the respective directions in which the apexes of longitudinally adjacent members point are 180° apart.

6. A toothbrush according to claim 5 characterised in that there are at least two members made of an elastomeric material with a region of the hard plastic material longitudinally between the at least two members, each of said members having a surface which is inclined at a non-perpendicular angle to the longitudinal direction, so that the surfaces of the adjacent regions of plastic material define an acute angle between the at least two members, being the apex angle of the triangular sectioned member.

7. A toothbrush according to claim 1, characterised in that there are at least two members made of an elastomeric material with a region of the hard plastic material longitudinally between the at least two members, each of said members having a surface which is inclined at a non-perpendicular angle to the longitudinal direction, so that the surfaces of the adjacent regions of plastic material define an acute angle between the at least two members, being the apex angle of the triangular sectioned member.

8. A toothbrush according to claim 7 characterised in that at least one longitudinally adjacent pair of the regions of hard plastic material are integrally linked by at least one thin integral bridge of the plastic material, being thin enough to be flexible.

9. A toothbrush according to claim 8 characterized in that the regions of hard plastic material comprise two or more planar parts inclined toward each other to define an acute angle between them, and linked together adjacent to an apex of the member which is triangular shaped in section to form a "V" shaped fold with the fold axis aligned transverse to the longitudinal direction.

10. A toothbrush having a longitudinal axis, with a head and a handle being made of a hard plastic material and being disposed along said longitudinal axis, the head having bristles extending therefrom in a bristle direction which is generally perpendicular to the longitudinal axis, the toothbrush having a width direction generally perpendicular to both the longitudinal axis and the bristle direction, the toothbrush having a resiliently flexible composite region between its head and handle characterised in that the composite region comprises two longitudinally separated regions of a hard plastic material, and at least one member which is triangular shape in section when cut in a plane parallel to the longitudinal direction and perpendicular to the width direction, the triangular shape having an apex which points in a direction 180° opposite to the bristle direction and which is made of a resilient elastomeric material different to the hard plastic material of the toothbrush head and handle which is situated longitudinally between said two adjacent regions of a hard plastic material.

11. A toothbrush according to claim 10 characterised in that the at least one member made of elastomeric material is constructed such that as a bending force is applied to the toothbrush head an adjacent region of hard plastic material bears upon the member to apply compressive pressure to the member.

12. A toothbrush according to claim 10 characterised in that there is more than one said member which is triangular shape in section, being sequentially longitudinally disposed in the toothbrush, and the respective directions in which the apexes of longitudinally adjacent members point are 180° apart.

13. A toothbrush according to claim 10 characterised in that there are at least two members made of an elastomeric material with a region of the hard plastic material longitudinally between the at least two members, each of said members having a surface which is inclined at a non-perpendicular angle to the longitudinal direction, so that the surfaces of the adjacent regions of plastic material define an acute angle between the at least two members, being the apex angle of the triangular sectioned member.

14. A toothbrush having a longitudinal axis, with a head and a handle being made of a hard plastic material and being disposed along said longitudinal axis, the head having bristles extending therefrom in a bristle direction which is generally perpendicular to the longitudinal axis, the toothbrush having a width direction generally perpendicular to both the longitudinal axis and the bristle direction, the toothbrush having a resiliently flexible composite region between its head and handle characterised in that the composite region comprises two longitudinally separated regions of a resilient elastomeric material different to the hard plastic material of the toothbrush head and handle, and at least one member which is triangular shape in section when cut in a plane parallel to the longitudinal direction and perpendicular to the width direction, the triangular shape having an apex which points in the bristle direction and which is made of a hard plastic material and which is situated longitudinally between said two adjacent regions of resilient elastomeric material.

15. A toothbrush according to claim 14 characterised in that the at least one member made of hard plastic material is constructed such that as a bending force is applied to the toothbrush head the hard plastic material bears upon an adjacent region of elastomeric material to apply compressive pressure to the region of elastomeric material.

16. A toothbrush according to claim 15 characterised in that there is more than one said member which is triangular shape in section, being sequentially longitudinally disposed in the toothbrush, and the respective directions in which the apexes of longitudinally adjacent members point are 180° apart.

17. A toothbrush according to claim 16 characterized in that there are at least two hard plastic material members with a region of the elastomeric material longitudinally between the at least two hard plastic material members.

18. A toothbrush according to claim 14 characterised in that one or more of the hard plastic members which are triangular shape in section are longitudinally penetrated by a longitudinally extending core of an elastomeric material.

19. A toothbrush according to claim 14 characterised in that there is more than one said member which is triangular shape in section, being sequentially longitudinally disposed in the toothbrush, and the respective directions in which the apexes of longitudinally adjacent members point are 180° apart.

20. A toothbrush according to claim 14 characterized in that there are at least two hard plastic material members with a region of the elastomeric material longitudinally between the at least two hard plastic material members.

21. A toothbrush according to claim 15 characterized in that there are at least two hard plastic material members with a region of the elastomeric material longitudinally between the at least two hard plastic material members.

22. A toothbrush according to claims 21 characterized in that at least one pair of longitudinally adjacent pairs of the hard plastic members which are triangular shape in section are linked by one or more thin flexible structure of the hard plastic material in the form of a thin integrally moulded bridge bridging pairs of the members.

23. A toothbrush according to claim 22, characterised in that one or more of the hard plastic members which are triangular shape in section are longitudinally penetrated by a longitudinally extending core of an elastomeric material.

24. A toothbrush according to claim 21, characterised in that one or more of the hard plastic members which are triangular shape in section are longitudinally penetrated by a longitudinally extending core of an elastomeric material.

25. A toothbrush according to claim 15, characterised in that one or more of the hard plastic members which are triangular shape in section are longitudinally penetrated by a longitudinally extending core of an elastomeric material.

26. A toothbrush according to claim 16, characterised in that one or more of the hard plastic members which are triangular shape in section are longitudinally penetrated by a longitudinally extending core of an elastomeric material.

27. A toothbrush having a longitudinal axis, with a head and a handle being made of a hard plastic material and being disposed along said longitudinal axis, the head having bristles extending therefrom in a bristle direction which is generally perpendicular to the longitudinal axis, the toothbrush having a width direction generally perpendicular to both the longitudinal axis and the bristle direction, the toothbrush having a resiliently flexible composite region between its head and handle characterised in that the composite region comprises two longitudinally separated regions of a resilient elastomeric material different to the hard plastic material of the toothbrush head and handle, and at least one member which is triangular shape in section when cut in a plane parallel to the longitudinal direction and perpendicular to the width direction, the triangular shape having an apex which points in a direction 180° opposite to the bristle direction and which is made of a hard plastic material and which is situated longitudinally between said two adjacent regions of resilient elastomeric material.

28. A toothbrush according to claim 27 characterised in that the at least one member made of hard plastic material is constructed such that as a bending force is applied to the toothbrush head the hard plastic material bears upon an adjacent region of elastomeric material to apply compressive pressure to the region of elastomeric material.

29. A toothbrush according to claim 27 characterised in that there is more than one said member which is triangular shape in section, being sequentially longitudinally disposed in the toothbrush, and the respective directions in which the apexes of longitudinally adjacent members point are 180° apart.

30. A toothbrush according to claim 27 characterized in that there are at least two hard plastic material members with a region of the elastomeric material longitudinally between the at least two hard plastic material members.

31. A toothbrush according to claim 27 characterised in that one or more of the hard plastic members which are triangular shape in section are longitudinally penetrated by a longitudinally extending core of an elastomeric material.

* * * * *